US006406331B1

(12) United States Patent
Brown

(10) Patent No.: US 6,406,331 B1
(45) Date of Patent: Jun. 18, 2002

(54) FUSE HOLDER WITH POSITIVE REMOVAL FEATURE

(75) Inventor: Michael N. Brown, Canton, MI (US)

(73) Assignee: Yazaki North America

( * ) Notice: Subject to any disclaimer, the term of this patent is extended or adjusted under 35 U.S.C. 154(b) by 0 days.

(21) Appl. No.: 09/909,105

(22) Filed: Jul. 19, 2001

(51) Int. Cl.[7] ..... H01R 13/68
(52) U.S. Cl. ..... 439/622
(58) Field of Search ..... 439/620, 621, 439/622

(56) References Cited

U.S. PATENT DOCUMENTS 5,171,293 A 12/1992 Umemoto et al. ..... 439/622
5,488,345 A * 1/1996 Seki et al. ..... 337/186
5,647,769 A * 7/1997 Takeuchi ..... 439/621
5,662,496 A * 9/1997 Kanamori ..... 337/186
5,680,088 A * 10/1997 Seki et al. ..... 337/194
5,816,858 A 10/1998 Kazarian et al. ..... 439/621
6,059,609 A * 5/2000 Nieto ..... 439/621

* cited by examiner

*Primary Examiner*—Tulsiidas Patel
(74) *Attorney, Agent, or Firm*—Young & Basile

(57) ABSTRACT

A fuse holder assembly for automotive-type fuses in an automotive fuse box, the fuse holder assembly being secured to the fuse box and mounting a fuse for movement relative to the fuse holder and the fuse box. The fuse is mounted on the holder for movement in a first direction for engaging and disengaging circuit terminals on the fuse box, and is further mounted for movement relative to the fuse holder in a second direction such that the fuse terminals are moved out of alignment with the circuit terminals on the fuse box. Moving the fuse in the second direction relative to the holder provides positive visual and mechanical assurance that the fuse is disconnected from the circuit terminals in the fuse box.

7 Claims, 4 Drawing Sheets

FUSE HOLDER WITH POSITIVE REMOVAL FEATURE

FIELD OF THE INVENTION

The present invention is in the field of fuse holders of the type used to retain automotive-type fuses an vehicle fuse boxes when the fuses are electrically disconnected from their circuits.

BACKGROUND OF THE INVENTION

Fuses are commonly used in automotive electrical systems to protect circuits against damage caused by overload conditions. Fuses for various circuits are often grouped together at clustered locations where circuit junctions exist in a fuse box, power distribution block, or junction block. It will be understood that the term "fuse box" used hereafter can mean any of these or any equivalent fused circuit junction or housing.

A fuse box is typically a molded plastic casing or housing containing internal fuse-receiving terminals connected to the various circuits by one or more bus bars. A typical automotive fuse has a generally rectangular plastic body with a pair of parallel, blade-like fuse terminals extending therefrom. The outer surface of the fuse box is provided with fuse sockets to allow the fuse terminals to be inserted into electrical engagement with the circuit terminals, thereby completing and fuse-protecting the associated circuit(s).

It is sometimes desirable to temporarily remove certain fuses from their associated circuits, for example to perform maintenance or simply to prevent battery drain. For example, it is good practice to disable the circuits related to airbag systems before working on any system or circuit located near the airbags in order to lessen the likelihood of unintentional activation of the airbags. For another example, clock circuits often maintain a continuous drain on the vehicle battery and should be turned off when the vehicle is being shipped or stored for long periods of time.

Since fuses are easily dropped or lost once removed from the fuse box, attempts have been made to retain fuses in physical association with the box even when disconnected electrically. Devices known as "fuse holders" are therefore often used to connect fuses mechanically to a fuse box in such a manner that the fuse can be moved into and out of electrical engagement with an associated fuse box socket while remaining connected to the fuse box. In particular, the fuse holder securely retains the fuse in a captive, pre-set position relative to the fuse box when the fuse is temporarily electrically disconnected from the socket, thereby maintaining the fuse in position for reinsertion into the socket. The fuse is fixed in place in or on the fuse holder, while the fuse holder typically is slidably connected to the fuse box for movement in the insertion/withdrawal direction of the fuse such that raising and lowering the fuse holder causes the fuse to be withdrawn from and inserted into its socket, respectively.

An example of such a fuse holder is illustrated in FIGS. 1 and 1A for a typical automotive fuse 16 of the type including a main body 16*a*, a flanged head 16*b* at the upper end of the main body 16*a*, and a pair of bayonet connector legs or terminals 16*c* extending downwardly from the lower end of the body. Body 16*a* and flanged head 16*b* are formed of a suitable moldable dielectric material and fuse terminals 16*c* are formed of a suitable conductive material and are electrically connected within body 16*a*, in known manner, by a suitable fusible link.

The illustrated fuse box example 12 is formed of a plastic or other moldable dielectric material in a generally rectangular configuration. A plurality of upwardly opening female terminal sockets 12*e, f, g* and *h* are provided on the upper side of the fuse box and a pair of guide members 12*j* and 12*k* are formed integrally with the upper edge of the fuse box on opposite sides of socket 12*h* to define vertical guide slots for the legs 14*b* of a fuse holder 14.

Fuse 16 is inserted into holder 14 through an opening in base 14*a* of the fuse holder which frictionally engages the sidewalls of fuse body 16*a* until flanged head 16*b* abuts base 14*a* and prevents further insertion. At this point, fuse 16 is fixed in holder 14 to permit the fuse and holder to be raised and lowered as a unit. Slots 14*e* in the legs 14*b* of the fuse holder engage pins 121 underneath the slot-defining guide members on each side of the socket, thereby defining the limit of travel of fuse holder 14. In FIG. 1, fuse holder 14 is raised to its maximum extent, such that fuse terminals 16*c* are withdrawn from socket 12*h* and therefore electrically disconnected from the associated circuit. FIG. 1A shows fuse holder 14 lowered to insert fuse 16 into socket 12*h* and thereby connect fuse terminals 16*c* with the associated circuit terminals in fuse box 12.

Although prior art fuse holders such as the one illustrated in FIGS. 1 and 1A provide positive removal of fuse terminals from their associated circuits, and in some cases further provide an indirect visual indication (by way of the raised state of the fuse holder) to maintenance personnel that the fuse is disconnected from the circuit, they do not provide a direct, positive, immediately-discernable indication that the fuse terminals themselves are fully disconnected. Moreover, prior art fuse holders are typically held in their raised, disconnected state by nothing more than friction or easily overcome detent structure, to enable service personnel to conveniently push them back down and reconnect the fuses with their associated circuits. This creates the possibility of the movable fuse holder being accidentally pushed down and the fuse being reconnected before it is advisable to do so. For example, if someone slips or drops a tool on the fuse holder, the fuse might be prematurely reinserted into its socket.

SUMMARY OF THE INVENTION

The invention is a fuse holder assembly for use on a fuse box, comprising a fuse holder and a fuse movably mounted on the fuse holder. The fuse is movable on the fuse holder between a fuse "ready" position in which the fuse is aligned for insertion and withdrawal from a socket or terminal on the fuse box, and a "safe" position in which the fuse is translated and/or rotated in the holder out of alignment with the socket on the fuse box to (1) make it readily visually apparent that the fuse is disconnected, and (2) positively prevent accidental insertion of the fuse terminals into the socket, even if the fuse holder is accidentally driven in the insertion direction.

DETAILED DESCRIPTION OF THE ILLUSTRATED EMBODIMENT

Figure 2:
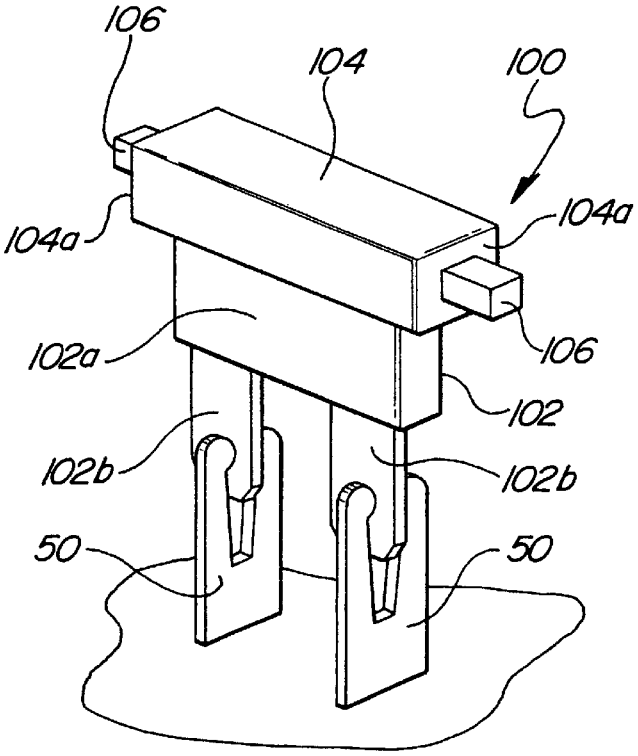
FIG. 2 is a perspective view of a "mini-fuse" type automotive fuse modified for use with a fuse holder according to the present invention.
Figure 2A:
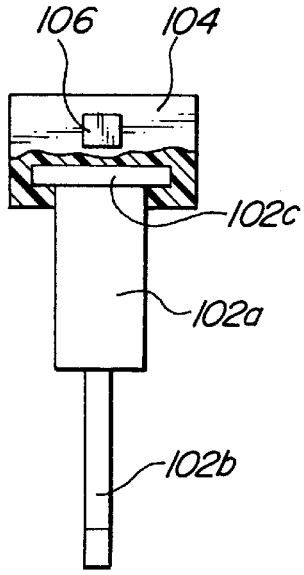
FIG. 2A is a side elevational view of the fuse of FIG. 2, with a portion of the fuse sectioned.

FIGS. 2 and 2A illustrate a modified fuse 100 in which a standard automotive-type fuse 102, such as a "mini" fuse, is modified with a "cap" 104 having guide members 106 extending to each side of the fuse. Fuses 102 typically comprise a plastic (dielectric) body portion 102*a* with a pair of conductive terminal blades 102*b* extending from body 102*a* in parallel fashion for insertion into standard fuse box terminals such as 50. In the illustrated embodiment, cap 104 is formed by molding additional plastic around the upper end or head 102*c* of fuse 102. It will be understood by those skilled in the art that modifications such as cap 104 and/or guide members 106 can be formed on fuse body 102*a* elsewhere than at the upper end. It will also be understood that while the illustrated embodiment shows a previously manufactured fuse 102 being subsequently provided with the guide structure 104, 106, fuse body 102*a* could be originally molded into guidable configurations such as shown in FIG. 2.

It will also become apparent to those skilled in the art that the size, shape, orientation, and type of such holder-engaging guide structure as 104, 106 can vary significantly without departing from the invention.

Figure 3:
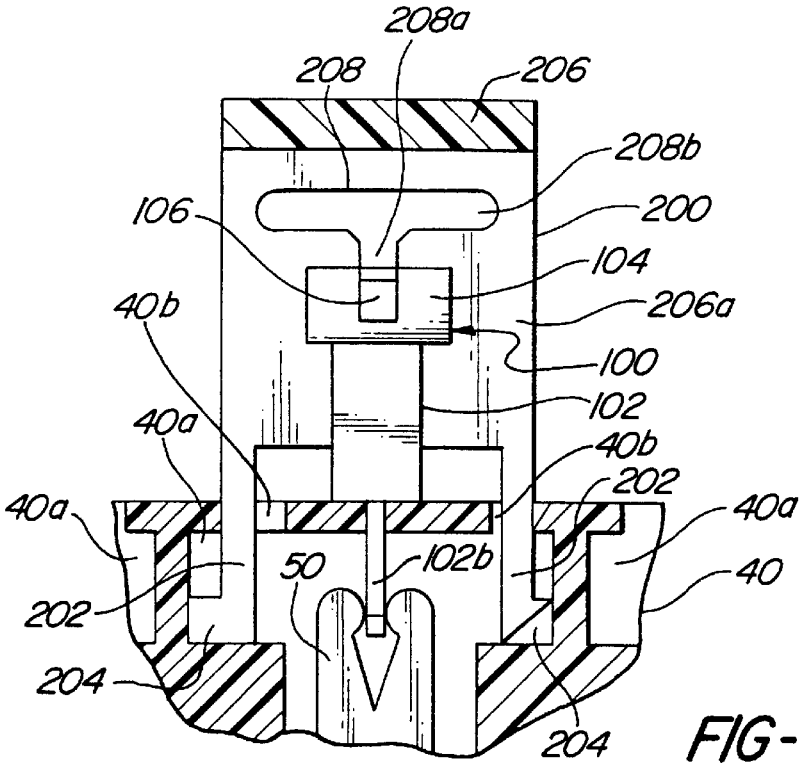
FIG. 3 is a side elevational view of the fuse of FIG. 2 mounted in a fuse holder according to the present invention, with the fuse holder lowered into the fuse box so as to place the fuse terminals in electrical contact with circuit terminals in the fuse box.
Figure 4:
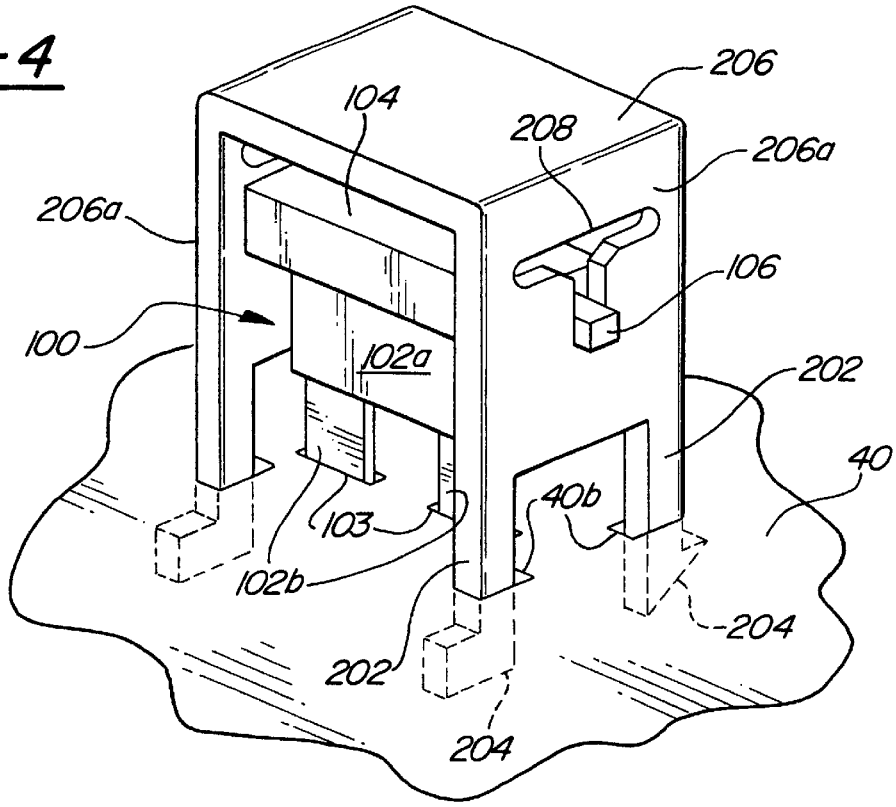
FIG. 4 is a perspective view of the fuse holder assembly of FIG. 3, raised from the fuse-connected position to a fuse-disconnected position.

Referring next to FIG. 3, fuse 100 as described above is movably mounted on a fuse holder 200. Fuse holder 200 is in turn mounted in or on a fuse box 40, in the illustrated embodiment fuse holder 200 having legs 202 with foot portions 204 inserted through openings 40*b* associated with a fuse socket 40*a* in which one or more pairs of fuse-receiving terminals 50 are mounted. In this particular example, as best shown in FIG. 4, one or more of the feet 204 may be beveled for a yielding fit into one or more associated openings 40*b*, such that once inserted, fuse holder 200 is trapped relative to socket 40*a* by feet 204. Fuse holder 200 is thus unlikely to be accidentally removed from the fuse box.

Figure 1:
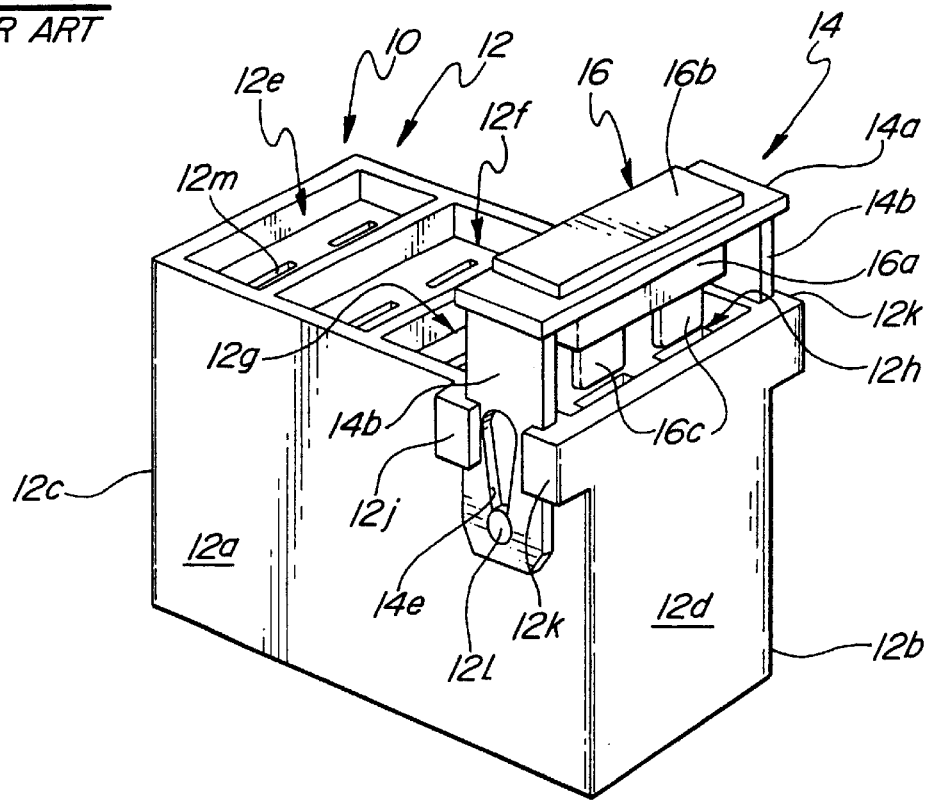
FIG-1 PRIOR ART
FIG. 1 is a perspective view of a prior art fuse holder attached to a fuse box and containing a typical automotive-type "mini-fuse", the fuse holder being illustrated in the raised, fuse-disconnected position.
Figure 1A:
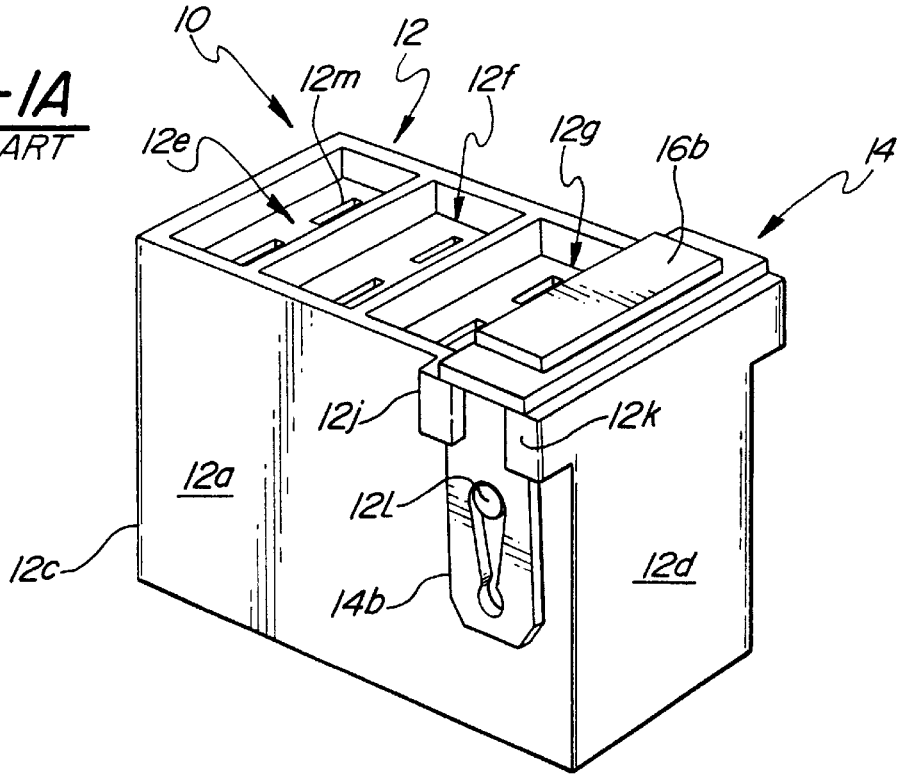
FIG-1A PRIOR ART
FIG. 1A is a perspective view of the fuse holder assembly of FIG. 1 lowered into its socket to connect the fuse to an appropriate circuit.

Fuse holder 200 preferably has a vertical range of motion relative to the fuse box and socket, in the illustrated embodiment defined by the depth of holes 40*b* in socket 40*a* and/or the length of legs 202. As will be apparent from FIGS. 1 and 1A, many different types of fuse holder/fuse box interconnection are known and can be adapted for use with the present invention, taking into account the nature and location of the associated fuse-receiving socket.

Fuse holder 200 preferably comprises a body made from a dielectric material such as an easily molded plastic, provided with guide structure 208 for receiving and retaining a portion of the modified fuse 100 and allowing the fuse to move between different positions on the fuse holder as will be described in greater detail below.

In the illustrated embodiment, fuse holder 200 has a body 206 with sidewalls 206*a*, each sidewall having a T-shaped slot 208. Sidewalls 206*a* are spaced enough to accommodate the width of fuse cap 104, but less than the distance between the ends of guides 106, such that guides 106 reside in guide slots 208 in the sidewalls. Slots 208 have a nominal width and appropriate geometry to slidingly accept guides 106. In the illustrated embodiment, guides 106 have a square cross-section which provides a preferred anti-rotation function in certain portions of slots 208.

Referring still to FIG. 3, fuse holder 200 is shown in its lowermost, fully inserted position in fuse box 40 with feet 204 resting on or abutting appropriate shoulder or shelf portions in socket 40*a* to prevent over-insertion. Fuse 100 is also in its lowermost, fully inserted position in which terminal blades 102*b* are placed in mechanical and electrical engagement with circuit terminals 50 in the fuse box through openings 103. In the illustrated embodiment, fuse body 102 rests on an upper surface of the fuse box to limit further insertion. Guides 106 are correspondingly in their lowermost position in the vertical sections 208*a* of slots 208.

In the fuse-connected condition of FIG. 3, fuse 100 is capable of conducting electricity through the circuit represented by terminals 50, and also of providing overcurrent protection to that circuit. However, in the event that it is desirable to disconnect fuse 100 from that circuit, for example for long term vehicle storage or for maintenance, fuse holder 200 allows the fuse to be disconnected from terminals 50 while keeping the fuse securely attached to the fuse box.

Figure 5:
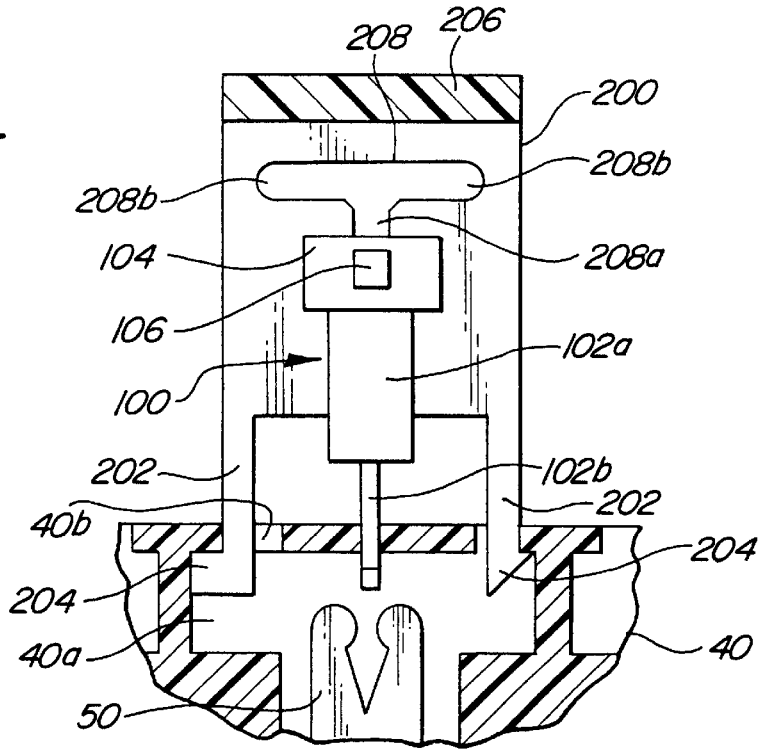
FIG. 5 is a side elevational view of the fuse holder assembly in the fuse-disconnected position of FIG. 4.

As shown in FIGS. 4 and 5, raising fuse holder 200 to its uppermost position disconnects fuse terminals 102*b* from circuit terminals 50. Guides 106 remain in the bottom of vertical slot sections 208*a*. Fuse terminals 102*b* may or may not be fully removed from socket openings 103; in the illustrated embodiment they are not. Fuse terminals 102*b* remain, however, in alignment with the socket openings.

As best shown in FIG. 5, feet 204 engage upper portions of socket 40*a* which prevent further upward travel.

Fuse holder 200 is preferably maintained in this raised, fuse-disconnected position by friction between feet 204 and the sidewalls of socket 40*a*. Alternately, detent structure of known type can be placed inside socket 40*a*, or molded into socket 40*a*, to interact with feet 204 and/or legs 202 to thereby maintain fuse holder 200 in its raised position once released by the person lifting it. It will also be understood by those skilled in the art that fuse holder 200 need not be maintained in a raised position shown in FIG. 5 once released, but can be loosely held in socket 40*a* for use primarily as a convenient "tool" for disconnecting fuse 100 from terminal 50.

It will also be understood by those skilled in the art that while it is highly preferable for fuse holder 200 to be movable between raised and lowered positions relative to socket 40*a*, it is not necessary for the operation of the invention for fuse holder 200 to be movably mounted on the fuse box. As will be understood from the following description of the movement of fuse assembly 100 relative to holder 200, it would be possible to use a fixed holder 200 and to initially disconnect fuse assembly 100 from circuit terminals 50 by grasping the protruding ends of guides 106 or by reaching into open portions of the fuse holder to grasp the fuse body directly.

Still referring to the initial fuse-disconnected condition of FIG. 5, fuse 100 remains at its lowermost position relative to fuse holder 200, namely with guides 106 resting at the bottommost end of the vertical portions 208*a* of slots 208.

Although fuse 100 in FIG. 5 is in a "safe" or disconnected condition which can be inferred from the raised condition of fuse holder 200, the present invention allows a more positive verification to be made, and further places the fuse in a condition in which it is impossible for it to be accidentally reconnected with terminal 50 if the fuse holder 200 is inadvertently driven down toward the socket. This is first achieved by giving the fuse a vertical range of motion relative to the fuse holder so that it can be independently lifted completely clear of the fuse box socket and terminals. This is further achieved by giving the fuse a rotational or translational range of motion relative to the fuse holder to place fuse terminals 102*b* out of alignment with socket openings 103, and further preferably to provide a more obvious visual indication that terminals 102*b* are fully removed from the fuse socket.

In the illustrated embodiment, fuse 100 is mounted in slot structure 208 for vertical movement along vertical slot portions 208*a*, and for translational and also preferably rotational motion in horizontal portions 208*b* of the T-shaped slot.

Figure 6:
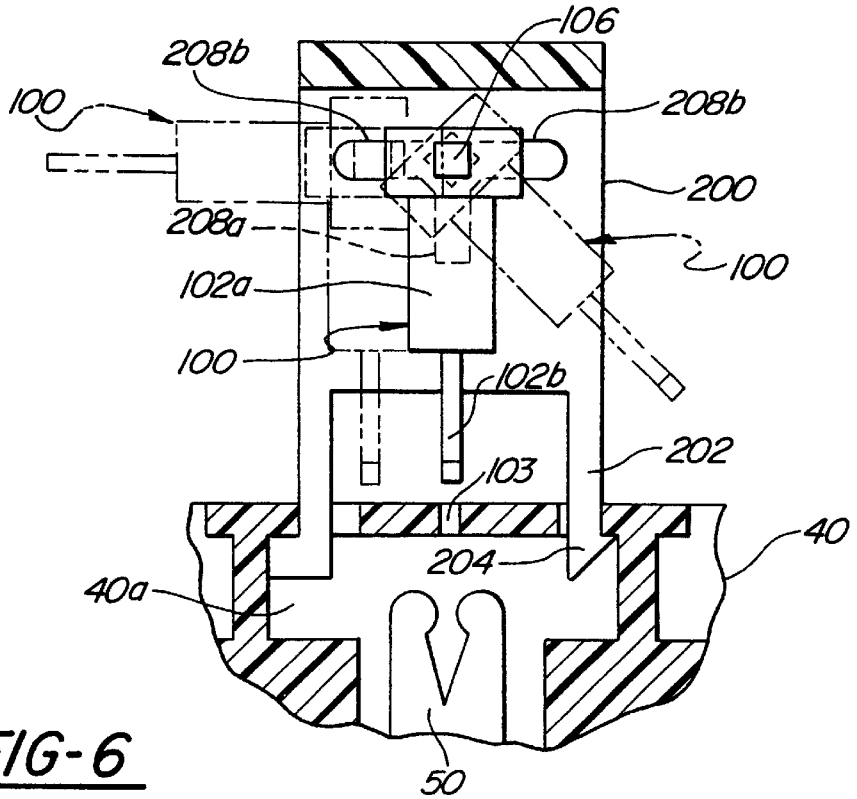
FIG. 6 is a side elevational view of the fuse holder in the raised position described above, and further showing the fuse itself raised relative to the holder (solid lines) and further .translated and/or rotated (in phantom lines) to safety-confirming positions.

Referring to FIG. 6, fuse 100 can be raised in fuse holder 200 with guides 106 traveling in the vertical portions 208*a* of slot 208. Once raised into alignment with horizontal slot portions 208*b*, fuse 100 can be simply translated to either side such that terminals 102*b* are no longer aligned with socket openings 103. Alternately, fuse 100 can be rotated approximately 90° and then slid to either end of horizontal slot portions 208*b* such that fuse terminals 102*b* are perpendicular to socket openings 103. Both types of movement will place fuse 100 in a position in which it is (a) more readily visually apparent that fuse terminals 102*b* are fully disconnected from the socket and its associated circuit, and (b) impossible for accidental downward movement of fuse holder 200 to reinsert fuse terminals 102*b* in socket openings 103 to connect them with circuit contacts 50.

Figure 7:
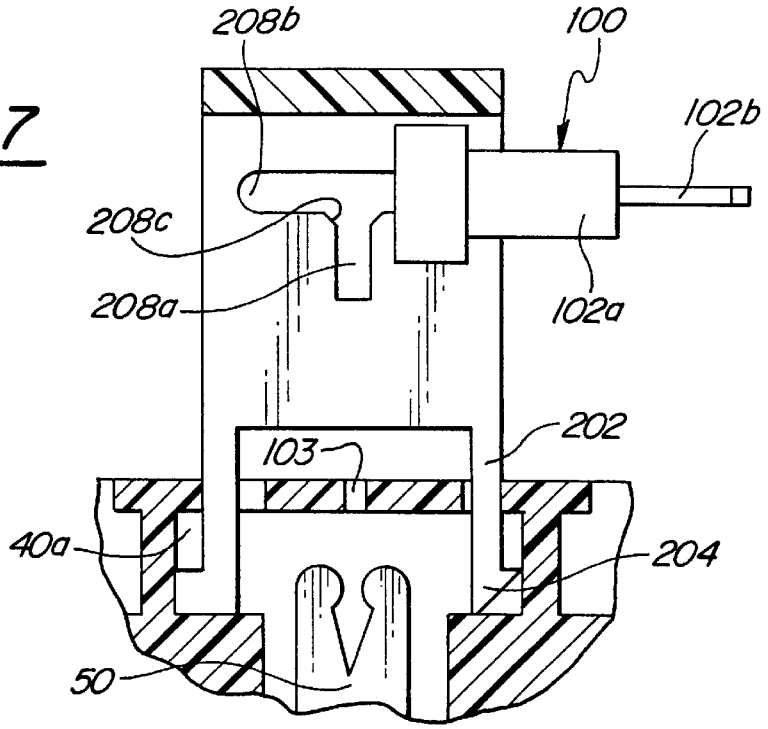
FIG. 7 is a clarified side elevational view of the fuse holder assembly with the fuse in one of the safety-confirming positions.

The square cross-section of guides 106, in conjunction with horizontal slot portions 208*b* whose width is only slightly greater than the width of guides 106, serves to hold fuse 100 in the rotated, horizontal position shown in FIG. 7. To assist with the initial rotational motion of the fuse, it is desirable to provide a clearance at the junction of vertical and horizontal slot portions 208*a*, 208*b*, for example by beveling the corners of the junction as shown at 208*c*.

It will of course be apparent to those skilled in the art that while a square cross-section guide 106 is both simple and effective, other relative geometries of these fuse supporting members and the slot or track structures in which they ride on the fuse holder can vary, depending on the desired range and direction of motion of the fuse relative to the fuse holder. For example, where a translational, lateral shift of the disconnected fuse and the holder is deemed to be sufficient and desirable, the guide and slot structure would not have to be configured to prevent rotation between them so as to hold the fuse assembly in a rotated position as shown in FIG. 7. For a simple translational shift, a rounded guide could be used.

While preferred translational and rotational movement of the fuse relative to the holder is illustrated, it would also be possible to mount the fuse in the holder for rotational movement parallel to the plane of socket 40*a*, or for greater or less than the 90° upward swing angle shown.

In order to place fuse 100 back into connection with circuit terminals 50, one simply translates and/or rotates the fuse back to the vertical position shown in solid lines in FIG. 6, and reinserts the fuse into socket 40*a* by pushing it downwardly.

It will be apparent from the foregoing description that the invention is capable of being modified to fit particular operating requirements, fuse box configurations, fuse styles, and the like without departing from the scope of the invention. It will be understood that the particular fuse holder and fuse illustrated are not intended to limit the invention, but merely represent one possible, currently preferred way of carrying out the invention. The manner in which the fuse holder is secured to the fuse box, the particulars of connection and relative movement of the fuse to the fuse holder, and other aspects of the invention can be readily modified by those skilled in the art now that I have disclosed my invention.

Accordingly, I claim:

1. A fuse holder assembly for securing an automotive fuse to fuse box structure in a manner which allows the fuse to be disengaged from an associated circuit while remaining connected to the fuse box, the fuse holder assembly comprising:

a fuse holder secured to the fuse box in association with a fuse socket comprising circuit terminals adapted to receive fuse terminals, and a fuse movably mounted on the fuse holder for movement in a first direction in which the fuse terminals are engaged and disengaged from the circuit terminals, and further movable on the fuse holder in a second direction in which the fuse terminals are misaligned with the circuit terminals such that motion of the fuse holder in the first direction is incapable of engaging the fuse terminals with the circuit terminals.

2. The apparatus of claim 1, wherein the fuse holder is movable on the fuse box in the first direction.

3. The apparatus of claim 1, wherein the fuse is mounted for translational movement on the fuse holder in a second direction perpendicular to the first direction.

4. The apparatus of claim 1, wherein the fuse is mounted for rotational movement on the fuse holder relative to the first direction.

5. The apparatus of claim 1, wherein the fuse is mounted for movement on the fuse holder for both translational and rotational movement relative to the first direction.

6. The apparatus of claim 5, wherein the fuse comprises a guide member, and the fuse holder comprises a guide, and the guide member is mounted in the guide for movement on the fuse holder.

7. The apparatus of claim 6, wherein the guide comprises a T-shaped slot, the slot having a vertical portion aligned with the first direction and a horizontal portion perpendicular to the first direction.

* * * * *